US005248964A

United States Patent [19]

Edgard et al.

[11] Patent Number: 5,248,964

[45] Date of Patent: Sep. 28, 1993

[54] SEPARATE FONT AND ATTRIBUTE DISPLAY SYSTEM

[75] Inventors: Glenn A. Edgard, Houston; Paul M. Garner, The Woodlands; Ronald B. Higgins; Christopher D. Miller, both of Houston, all of Tex.

[73] Assignee: Compaq Computer Corporation, Houston, Tex.

[21] Appl. No.: 336,864

[22] Filed: Apr. 12, 1989

[51] Int. Cl.[5] ..... G09G 3/00

[52] U.S. Cl. ..... 345/114; 345/143; 345/25

[58] Field of Search ..... 340/703, 732, 735, 747, 340/789, 790, 750

[56] References Cited

U.S. PATENT DOCUMENTS

| | | | |
|---|---|---|---|
| Re. 32,201 | 7/1986 | Bradley . | |
| 4,429,306 | 1/1984 | Macauley et al. | 340/790 |
| 4,451,824 | 5/1984 | Thayer et al. | 340/732 |
| 4,504,828 | 3/1985 | Couper et al. | 340/735 |
| 4,646,077 | 2/1987 | Culley . | |
| 4,742,350 | 5/1988 | Ko et al. | 340/735 |
| 4,827,253 | 5/1989 | Maltz | 340/703 |
| 4,837,710 | 6/1989 | Zelinsky et al. | 340/703 |
| 4,857,904 | 8/1989 | Schoon | 340/703 |
| 4,862,154 | 8/1989 | Gonzalez-Lopez | 340/747 |
| 4,879,666 | 11/1989 | Kembo | 340/735 |
| 4,893,114 | 1/1990 | Ishii | 340/735 |
| 4,910,505 | 3/1990 | Beaven et al. | 340/747 |

FOREIGN PATENT DOCUMENTS

| | | |
|---|---|---|
| 58-056078 | 2/1983 | Japan . |
| WO82/01614 | 5/1982 | PCT Int'l Appl. . |

OTHER PUBLICATIONS

W. Newman & R. Sproull, Principles of Interactive Computer Graphics, 1979, pp. 220-223.

Compaq Computer Corp., Compaq Video Graphics System Technical Reference, pp. 1-1 to 1-10 and 2-1 to 2-58 (1988).

*Primary Examiner*—Ulysses Weldon
*Assistant Examiner*—M. Fatahiyar
*Attorney, Agent, or Firm*—Pravel, Hewitt, Kimball & Krieger

[57] ABSTRACT

A method and circuitry for using two buffers containing video display information is shown. One buffer contains character mask or dot image information, while the other buffer has two portions, foreground and background, which store attribute information. In non-compatible write operations attribute information stored in registers is written to the attribute buffers when mask information is written to the first buffer. In compatible write operations the attribute value is written to the foreground attribute buffer and zero is written to the background buffer, while an OR'ed value of the attribute value is written to the first buffer. In non-compatible read operations the value in the first buffer may be obtained or a CRC value may be generated on the entire character cell. The CRC value can be compared with similar CRC values developed on the character mask of interest to determine if a character is present in the cell. In compatible mode read operations the value in the foreground or background buffer is selected based on the value in the first buffer. In display drive operations a similar selection is made and the value supplied to the circuitry driving the display.

2 Claims, 9 Drawing Sheets

CPU
10
C
RAM
12
BUS CONTROL
14
30
32
DMA
ROM
LATCHES/ BUFFERS/ TRANSCEIVERS
SLOTS
16
20
34
24
VIDEO SYSTEM
36
CRT
38
18
22
TRANSCEIVERS
28
I/O DEVICES
KEY BOARD
26

B
C
F
SET 128 CHAR.
336
INITIALIZE CHAR.COMPARE INDEX
332
ROM - BASED CHAR. ?
338
NO
YES
USE PRECALCULATED FONT CRC
340
LOAD CHAR. CELL HEIGHT
344
INITIALIZE CRC ACCUMULATOR
346
OBTAIN PIXEL BYTE FROM FONT
348
ACCUMULATE INTO CRC ACCUMULATOR
350
INCREMENT TO NEXT FONT SCAN LINE
352
DECREMENT HEIGHT
354
HEIGHT = 0 ?
356
NO
YES
USE ACCUM. CRC
358
CRC MATCH ?
342
YES
NO
D
POINT IN NEXT CHAR. IN FONT
360
INCREMENT CHAR.COMPARE INDEX
362
E

SEPARATE FONT AND ATTRIBUTE DISPLAY SYSTEM

BACKGROUND OF THE INVENTION

1. Field of the Invention

The invention relates to display systems for computers, and more particularly to display systems having graphics modes of operation.

2. Description of the Related Art

Personal computers are equipped with display systems so that information can be provided to the user. Typically the display systems can operate in character or graphics mode and can be used with monochrome or color displays. The display system commonly has a buffer, called the video buffer, which is addressable by the processor in the computer and which contains values relating to the information to be displayed. These values are provided to circuitry which obtains these values and properly converts them for control of the display, conventionally a cathode ray tube (CRT) or a liquid crystal display (LCD).

In text or character mode of operation the values written to the video buffer are in the form of encoded values representing entire characters, such as ASCII. The circuitry utilizes these character values and stored font information to develop a pixel data stream for presentation to the actual display device. The circuitry typically obtains the character value for a given display location and obtains the necessary pixel information for a given scan line from a font generator. These pixel values are then transmitted to the display driver circuitry. Because the ASCII values, for example, are stored in the video buffer it is quite easy to write and read the character values at a given display position. The display location is converted to the proper address in the video buffer and a write or read operation performed.

This situation is complicated in graphics mode, also referred to as all points addressable (APA) mode. In this mode the on/off state or color of each pixel is individually determined by the contents of a corresponding value, a single bit or a series of bits, in the video buffer. Thus, characters are developed on the display by use of a group of pixels, for example 64 pixels in an $8 \times 8$ array, each pixel being set to a desired state to define the character. To complicate matters each pixel may have attributes, commonly color values when in graphics mode, associated with it. Therefore a write operation is not a simple task of writing a character value to a single location in the video buffer, but involves writing the proper values to each pixel forming the group or array.

Reading a character value is even more difficult in that the pixel values in the array must be matched to a preset font array to determine the character actually present at a given location. This matching involves a very large number of processor operations and as a result is quite slow.

One technique for performing the write and read operations of characters when a display system is in graphics mode is shown in U.S. Pat. No. 4,408,200 to Bradley, reissued as Re. 32,201. This patent disclosed using a dot image or mask of the desired character which was stored in a read only memory (ROM). The dot image contained a compressed value of the actual information to be placed in the video buffer. The compressed values were either 0 where a background color was to be used or a 1 where a preselected color was to be used. Each character in the ROM was formed by 8 bytes, while the corresponding values in the video buffer were 8 words, that is, twice the size of the compressed values. The compressed dot image values were expanded by utilizing two bits for each bit in the compressed format, with the two bits indicating the desired color of the pixel, either the background for a 00 value or one of three color values if a non-00 value was present. This expansion was done by analyzing the dot image single bits and converting them to the corresponding double bits. This technique was not wholly satisfactory for operation because the processor was required to do each of the expansions for each pixel in each character, thus using large amounts of processor time.

The read operations were likewise slow and difficult. Because the video buffer values did not correspond directly to character values, compression was required for each pixel in each character desired, which then had to be matched against the dot image information available f rom the font table. Very large numbers of processor, memory and slow video buffer accesses were required to perform the operation.

SUMMARY OF THE INVENTION

The display system of the present invention allows simplified, more processor efficient operation for writing characters to and reading characters from the video buffer when in graphics mode. A display pattern refresh buffer (DPRB) is used to store pattern information relating to the use of background or foreground attribute information. Foreground and background attribute buffers are used to contain the color information related to a given pixel as identified in the DPRB.

Two types of operation are defined, a compatible mode for use by application programs executing in the computer and a non-compatible mode for use by the subroutines provided by the computer manufacturer. Processor read and write operations are defined for each type of operation, as well as read operations for display driving purposes.

In non-compatible type write operations, foreground and background attribute or color information for the character is first written to foreground and background registers. With these registers loaded, the desired foreground or background dot image or mask values of the pixels forming the character is written to the display system. The display system places the dot image values directly in the DPRB and copies the foreground and background register values into the foreground and background attribute buffers at locations corresponding to the pixel locations of the bits in the DPRB. Thus the character image is directly stored in the DPRB and the attributes for the character are stored in the attribute buffers. To obtain the values used to drive the display, each pixel location in the DPRB and the corresponding location in the attribute buffers are read. If the DPRB value is a 1, the foreground attribute value is used to drive the display, while if the DPRB value is a 0, the background attribute value is used. Thus the processor need only load the attribute registers and then transfer the character dot image to the display system. No involved expansion techniques are required.

Non-compatible character read operations are performed differently and only utilize the values in the DPRB. To reduce the time required to perform the matching operation a cyclic redundancy check (CRC)

value is developed for the entire character pixel group contained in the DPRB. This CRC value can be obtained by clearing a CRC unit and reading each scan line value of the character in the DPRB to the unit and then reading the final CRC value. This obtained value is then compared with predetermined CRC values if the font provided by the computer manufacturer is being used or against calculated CRC values if another font is being used. If a match is found the character value is returned, while a value indicative of an unsuccessful match is returned if no match is found. Non-compatible video buffer read operations also are available which allow reading of the values in the DPRB.

Compatible write operations are such that DPRB values are developed. The application program writes a value containing full attribute information to the display system at the desired location. This information is transferred to the foreground attribute buffer at that location and a zero value is written to the background attribute buffer at that location. The individual bits forming the attribute value are OR'ed together and the resulting value is written to the DPRB at the desired pixel location or locations. Thus an attribute value of zero indicates the use of the background attribute buffer and so the positioning of the 1 values indicates the character dot image or mask. By developing the DPRB values in this manner non-compatible type operations can be utilized to perform read operations as well as compatible type read operations.

Compatible type read operations are performed similarly to display drive read operations, in that the data is obtained from both the background and foreground attribute buffers, with the selection of which value to provide to the processor and the application program being based on the state of the particular pixel in the DPRB.

Thus by using separate DPRB and attribute buffers character reading and writing in graphics mode is simplified.

BRIEF DESCRIPTION OF THE DRAWINGS

A better understanding of the invention can be had when the following detailed description of the preferred embodiment is considered in unction with the following drawings, in which.

DETAILED DESCRIPTION OF THE PREFERRED EMBODIMENT

Figure 1:
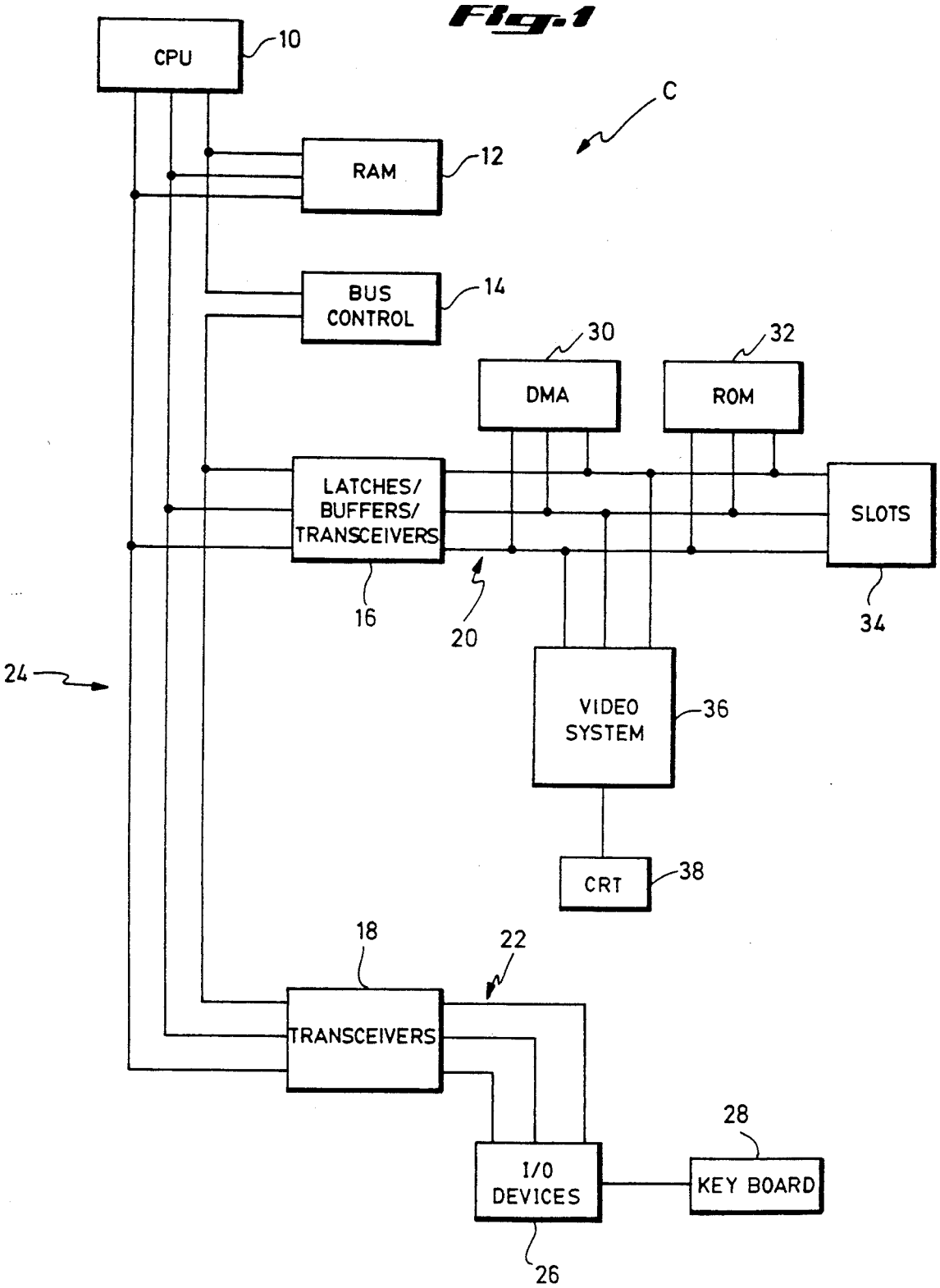
FIG. 1 is a block diagram of a computer system incorporating the invention.
Figure 2:
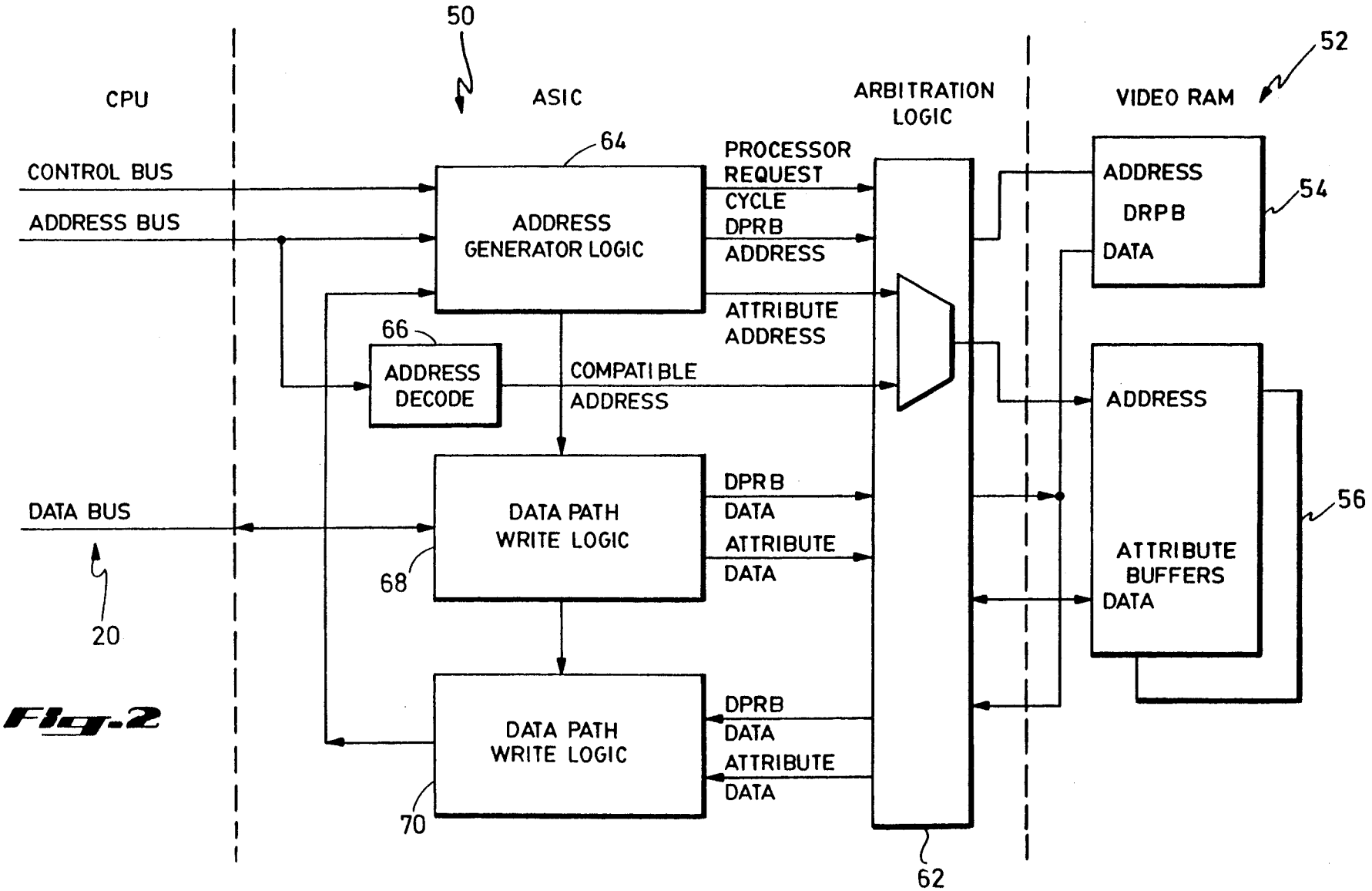
FIG. 2 is a block diagram of portions of a display system incorporating the present invention.

Referring now to FIG. 1, the letter C generally refers to a computer incorporating the present invention. The computer C includes a processor 10 to which is connected main system memory 12, a bus controller 14 and various latches, buffers and transceivers 16 and 18 used to form separate buses 20 and 22 from a processor bus 24 formed by the address, data and control lines developed by the processor 10 and the bus controller 14. One of the separate buses 22 is considered the input/output (I/O) bus and is used to connect certain devices and systems 26 which are accessed through the I/O space of the processor and are located on the main circuit board used in the computer C. A keyboard 28, for example, is connected to the I/O devices 26 and thus the processor 10 can determine when the user strikes the various keys.

The second bus 20 can be considered the system bus and has items such as a direct memory access (DMA) controller 30, a read only memory (ROM) 32 which stores operating sequences of the computer C and a series of slots or connectors 34 for insertion of interchangeable circuit boards which can provide additional functionality to the computer C. Also connected to the system bus 20 in the example shown in FIG. 1 is a display or video system 36 which in turn has connected to it a cathode ray tube (CRT) 38 or other display device, such as a liquid crystal display (LCD) or a plasma display. The video system 36 handles the storage and display control functions for information which is to be displayed to the user. Various types of information can be written to the video system 36 to cause certain other information to be displayed on the CRT 38 as is explained in the background and following in this description.

The video system has as two of its main portions an application specific integrated circuit (ASIC) 50 and video RAN 52. The use of an ASIC 50 allows numerous logic functions to be incorporated in a very small space, thus allowing improved functionality in a smaller physical space and with less power consumption. In a computer c incorporating the present invention the video RAM 52 has two portions, a display pattern refresh buffer (DPRB) 54 and attribute buffers 56. In this specification graphics mode operation is assumed unless otherwise indicated. The DPRB 54 is used to store the pattern or dot image of any characters associated with a given pixel block size, a single bit being used to represent each pixel that can be displayed in a given display mode. The value or state of the pixel is used to indicate whether foreground or background information is to be used to control the actual pixel displayed on the CRT 38. Thus for a given pixel block, for example an $8\times8$ array, the location of the 1 values in the DPRB 54 indicates the use of the foreground information and so is a mask or dot image of the character contained in that block. The attribute buffers 56 contain the attribute, preferably color, values associated with each pixel in the DPRB 54. The attribute buffers 56 are preferably split into a foreground buffer 58 (FIG. 4) and a background buffer 60, with each buffer 58 and 60 containing the necessary color information for each pixel.

The ASIC 50 has several major blocks and is connected to the processor 10 over the system bus 20. Information is written to and read from specific registers in the ASIC 50 by means of I/O operations, which are decoded by circuitry which is not shown. The ASIC 50 also handles or controls all transfers of information between the processor 10 and the video RAM 52. This is necessary for several reasons, one of which is that the video RAM 52 is being accessed by the circuitry reading the video RAM 52 to drive the CRT 38 and can be accessed by the processor 10 to read or write information directly to the video RAN 52 for presentation on the CRT 38. To this end the ASIC 50 contains arbitration logic 62 which determines when the processor 10 can have access to the video RAN 52, when the video RAM 52 is providing information to the display drive circuitry and when the video RAN 52 is being refreshed to prevent loss of data. The arbitration logic 62 thus drives the addresses to the DPRB 54 and the attribute buffers 56 and transfers the data to or from the DPRB 54 and the attribute buffers 56 as needed.

The processor 10 requests access to the video RAM 52, with address generator logic 64 interfacing to the processor 10 to determine the address and direction of the operation. Two modes of operation are identified for processor 10 transfers. In non-compatibility mode the address generator logic 64 develops the addresses necessary to address the DPRB 54 and the attribute buffers 56. In compatible mode the addresses are generated by an address decoder 66. The address generator logic 64 also develops a processor request cycle signal which is presented to the arbitration logic 62 to indicate to the arbitration logic 62 that a processor 10 request is pending. The arbitration logic 62 recognizes the signal and allows the operation to be performed at the first available interval, generally when no display drive or refresh operations are occurring. The address generator logic 64 additionally contains a latch or register (not shown) which is used to hold a compatibility mode value. This value is supplied to data path write logic 68 and data path read logic 70.

Figure 3:
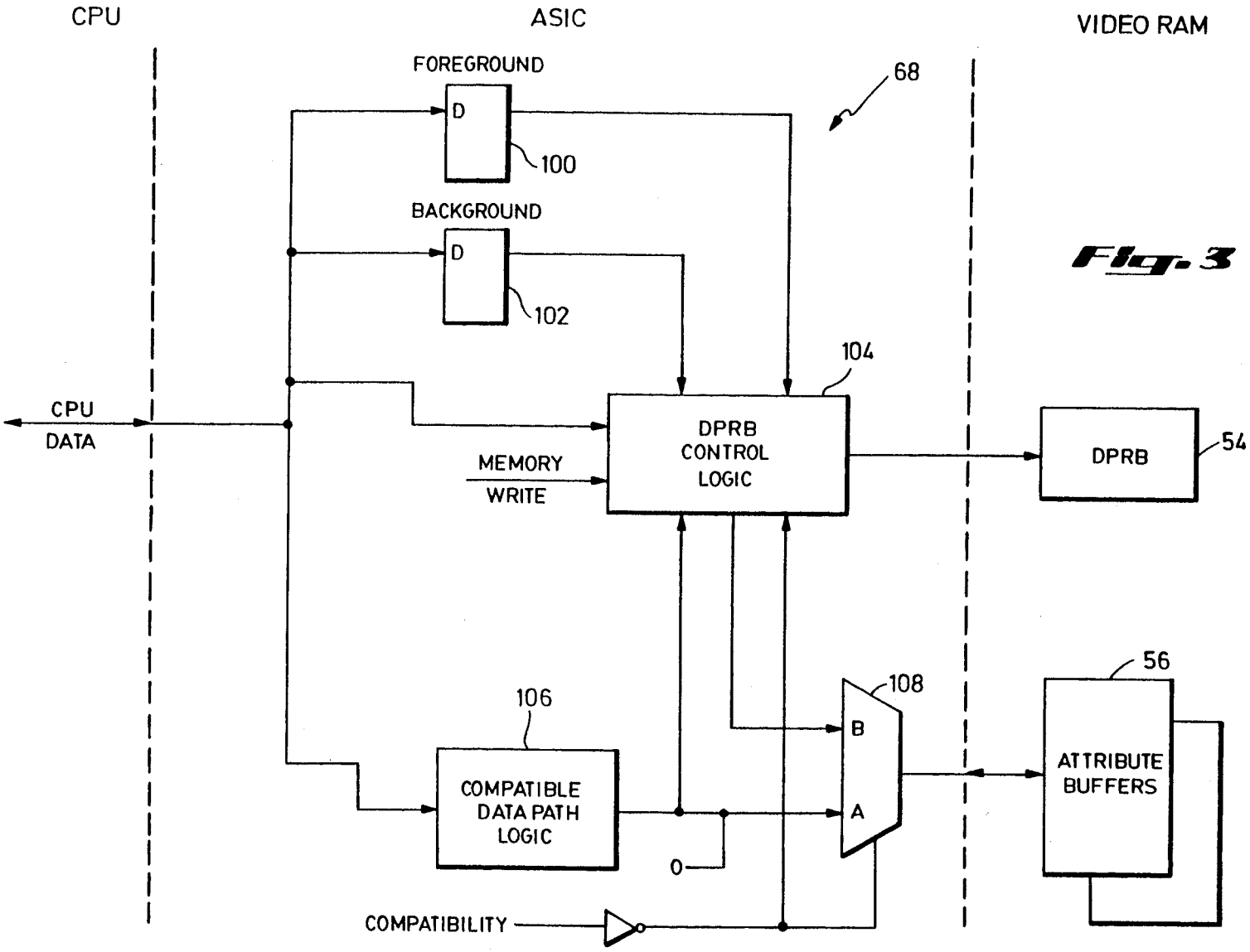
FIGS. 3, 4 and 5 are more detailed block diagrams of portions of a display system incorporating the present invention.
Figure 5:
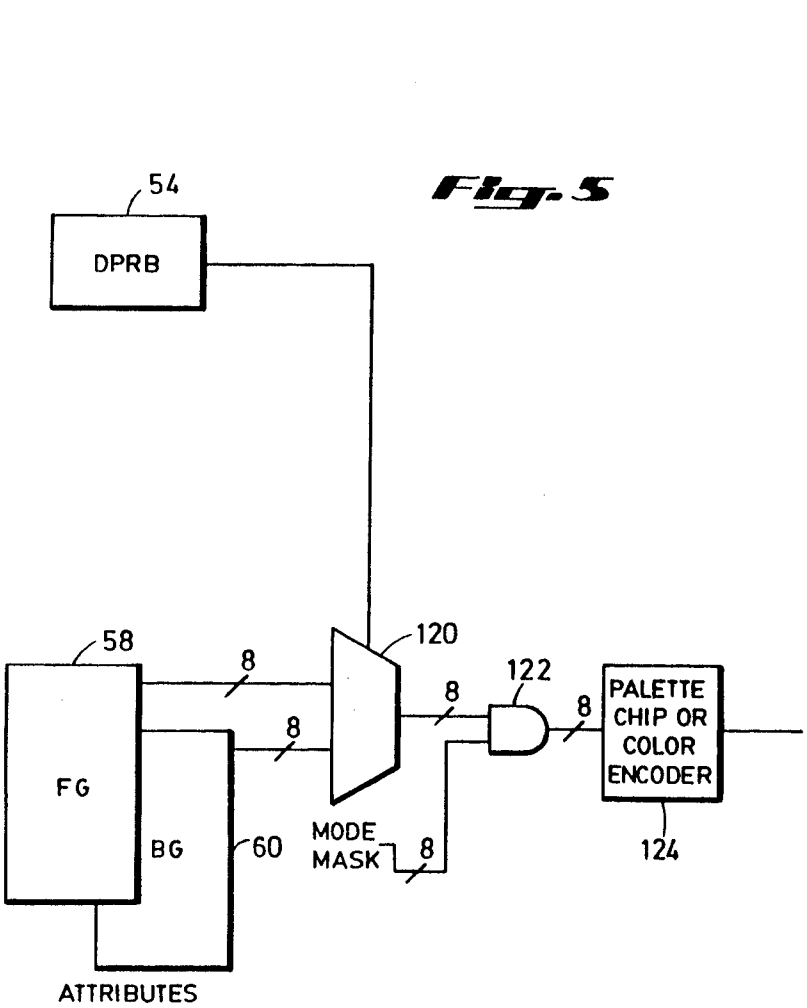

The write data path logic 68 is shown in more detail in FIG. 3. Two registers 100 and 102 are used to store foreground and background attribute data, respectively. This data is written to the registers 100 and 102 by I/O write operations performed by the processor 10 to an I/O address space assigned to the ASIC 50. The registers are preferably eight bits wide to handle attribute information for currently standard graphics operating modes, such as mode 13 according to the standard convention. The registers 100 and 102 can be of the widths necessary for operation in the given video system based on the color palette chip used and the number of colors to be used at a given time. The registers 100 and 102 provide their outputs to the DPRB control logic 104. The processor data is supplied to the DPRB control logic 104 and is supplied to the compatible data path logic 106.

The DPRB control logic 104 is used to determine the values to be written to the DPRB 54 and to the attribute buffers 56 when in non-compatibility mode operation. When in compatible mode operation the data provided by the compatible data path logic 106 is transferred to the foreground attribute buffer 58 and zeros are transferred to the background attribute buffer 60. This selection process is performed by a multiplexer 108 whose transfer is controlled by the compatibility value. The output of the compatible data path logic 106 is also provided to the DPRB control logic 104 for use in developing the proper DPRB value when a compatible mode write is being performed.

The general flow of the data is as follows. When in non-compatible mode and a write operation is performed by the processor 10, the values in the foreground and background registers 100 and 102 are transferred to the appropriate pixel location corresponding to the pixel location of the dot image or DPRB value being written and the value representing whether the foreground or background value is to be used is written to the DPRB 54. This foreground or background value is a one if the foreground value is to be used or zero if the background value is to be used. Thus the location of the ones in the matrix forming the character can be considered the pixel mask or character dot image. Thus the mask is stored in the DPRB 54 -and the attributes for each pixel location are stored in the attribute buffers 56. If multiple pixel values are being presented in a single write operation, for example when the character is represented in an $8\times8$ array, the DPRB control logic 104, interacting with the address generator logic 64, repeats the process as necessary until all the values supplied by the processor 10 have been properly stored in the DPRB 54 and the corresponding foreground and background attribute values have been stored in the attribute buffers 56. For example, if the DPRB is addressable on a single bit basis and the attribute buffers also addressable on a single bit basis, but are eight bits deep to handle an eight bit attribute value, and the processor 10 writes a byte containing eight pixel values, the DPRB control logic 104 and the address generator logic 64 repeat the read operation eight times, incrementing the bit address each time to obtain the proper address value. The number of repetitions of the cycle is dependent therefore on the mode of operation of the unit, that is, the number of bits in an attribute value, and the organization of the memory circuits forming the DPRB 54 and the attribute buffers 56. Thus the processor 10 need only set up the proper foreground and background attribute values in the foreground and background registers 100 and 102 and write the character mask to the video system 36 to transfer the information necessary to display a character in a graphics mode.

Compatible mode write operations are different. These operations are utilized by application programs executing in the computer C which do not desire to use the subroutines provided by the computer manufacturer, which use the non-compatible mode operations. The application simply writes the desired attribute information to the desired pixel location as identified by various registers in the ASIC 50. The attribute information is passed to the foreground attribute buffer 58 and zeros are written to the background attribute buffer 60 at that location. The attribute information being written by the application program is also passed to the DPRB control logic 104. The DPRB control logic 104 OR's each of the bits in the attribute value together. The result of the OR operation is then written to the proper pixel location or locations in the DPRB 54. Thus, when the attribute value is non-zero it is considered to be a foreground value and a location in the character. If the attribute is zero, it is considered to be a background value and not a location in the character. Therefore if the application program is utilizing the zero color for background, the values stored in the DPRB 54 and the attribute buffers 56 are the same as if a zero background value was stored in the background attribute register 102 and the desired value was stored in the foreground register 100 and the character mask written in non-compatible mode.

Figure 4:
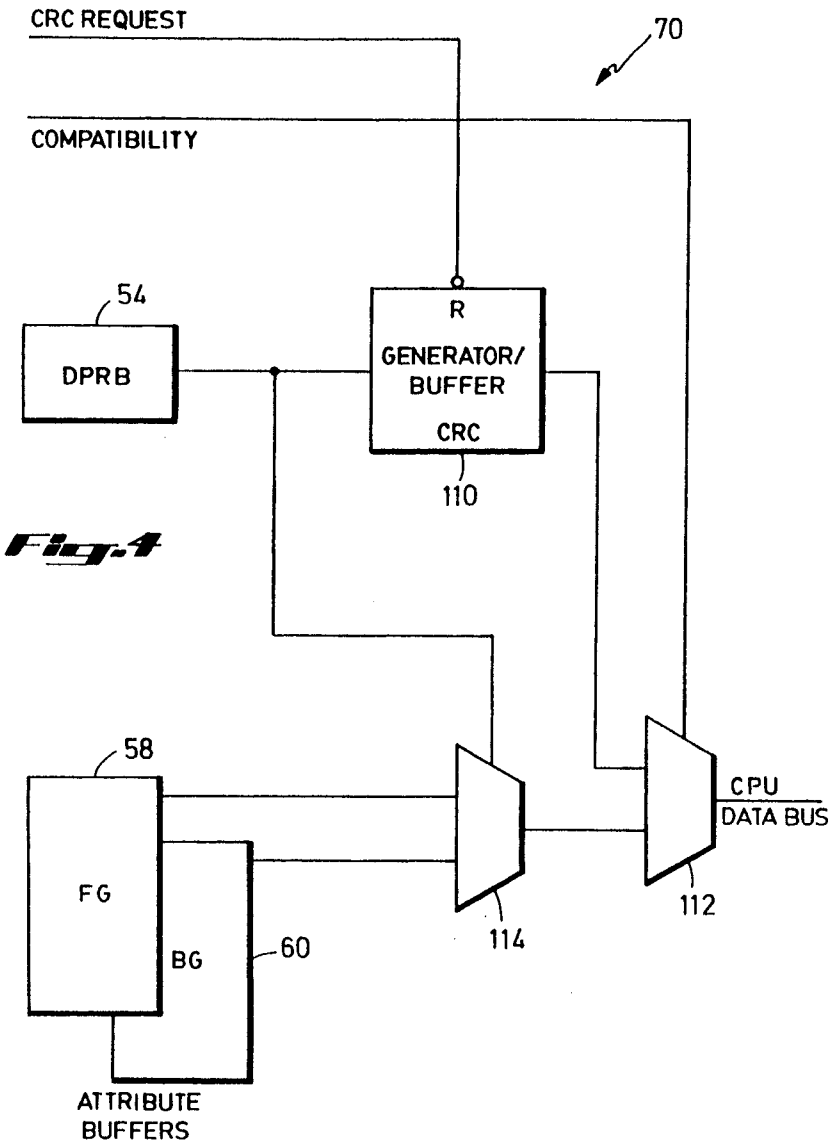

The data path read logic 70 is shown in more detail in FIG. 4. As discussed in background discussion, determining character matches when using a graphics mode is difficult. The data path read logic 70 simplifies this process. There are three types of read operations, non-compatible character mask read, non-compatible character signature value read and compatible attribute read. Two values must be set for read operations, the compatibility value as previously discussed and a CRC request value used to indicate signature mode operation.

In non-compatible character mask read operations the information in the DPRB 54 is passed directly to the processor 10. The processor 10 clears the compatibility value, sets the desired pixel address and reads the video system 36. The DPRB values are transferred from the DPRB 54 to a CRC generator/buffer 110. The CRC generator/buffer 110 is in buffer mode because the CRC request value is low, so the values are transferred to a multiplexer 112 whose output is coupled to the processor data bus. The multiplexer 112 has the compatibility value used as its transfer control signal, so that in this case the value is low and the DPRB values are transferred. In this manner the processor 10 can easily determine the character mask for a given character cell, without having to do complex disassembly operations.

In non-compatible character signature value read operations, the compatibility value is set low and the CRC request value is high. The processor 10 sets the desired pixel or cell location and performs a read operation. The values in the DPRB 54 are transferred to the CRC generator/buffer 110, which performs a partial CRC on the values. This is the first CRC and the accumulating value was previously zero because when the CRC generator/buffer 110 is in buffer mode the accumulator is cleared. This partial CRC value is output by the CRC generator/buffer 110 and gets transferred to the processor data bus, but the values are ignored by the processor 10 because this is not the last CRC operation. This process is repeated until all the lines in the cell or all the pixels in the cell have been read. The final CRC value is used by the processor 10 because this is the completed CRC and the final signature for the cell. The CRC value is stored for comparison with character mask derived CRC values as will be described later. It is noted that the CRC operation could be performed entirely by the CRC generator/buffer 110 by causing a series of read operations once the operation has been requested. It is also noted that other methods could be utilized for developing a signature indicative of the values residing in the DPRB 54 and the character masks to be compared.

In the compatibility mode read operations, the values in the foreground attribute buffer 58 or the background attribute buffer 60 are provided to the processor 10. The compatibility value is set high so that the multiplexer 112 transfers the values presented at the other input, in this case from a second multiplexer 114. The inputs to the second multiplexer 114 are the outputs of the foreground attribute buffer 58 and the background attribute buffer 60. The transfer control value is provided by the output of the DPRB 54. The processor 10 requests a read in compatible mode and the proper address is presented by the address generator logic 64 to the DPRB 54 and the attribute buffers 56. All three buffers 54 and 56 provide their data values and the selection of foreground or background values is based on the mask value contained in the DPRB 54. This is thus the converse of the operation performed on writing data, either in compatible or non-compatible modes.

The read operations discussed above are repeated as necessary in a manner similar to the write operations.

Thus the processor 10 can read either the derived or written mask values in the DPRB 54, a signature value to allow simpler character read operations or the attribute value stored in the attribute buffers 56.

The attribute values must also be provided to the CRT 38 to cause the proper color to be displayed at the proper locations. The arbitration logic 62 provides the addressing signals needed to scan the display and the video RAN 52 in a raster mode. These addresses are presented to the DPRB 54, the foreground attribute buffer 58 and the background buffer 60 so that data values are presented by each buffer 54, 58 and 60. The foreground and background values are provided as the two inputs to a multiplexer 120. The multiplexer 120 is of the necessary width, preferably eight bits for compatible operation with personal computers developed by International Business Machines Corp. The value output by the DPRB 54 is provided to the transfer input of the multiplexer 120. When the DPRB 54 value is a one, the foreground value is transferred by the multiplexer 120, while when the value is zero the background value is transferred. The output of the multiplexer 120 is connected to one input of a series of two input AND gates 122. The other input of the AND gates 122 is connected to a mode mask value. The ASIC 50 stores the value of the video graphics mode in which it is operating. This video mode value is converted into a binary string indicative of the number of bits used in the attribute values of that particular mode. This automatically masks out unused bits in the attribute buffers 56 if modes which do not require the full width are used so that proper values are presented to the palette chip or color encoder 124. The palette chip 124 receives the outputs of the AND gates 122 and provides the digital to analog transformation or other transformation to convert the attribute values into values suitable for driving the CRT.

Thus the proper attribute values are provided to the display drive circuitry and yet the ease of character operations in graphics operations is not hindered.

Figure 6A:
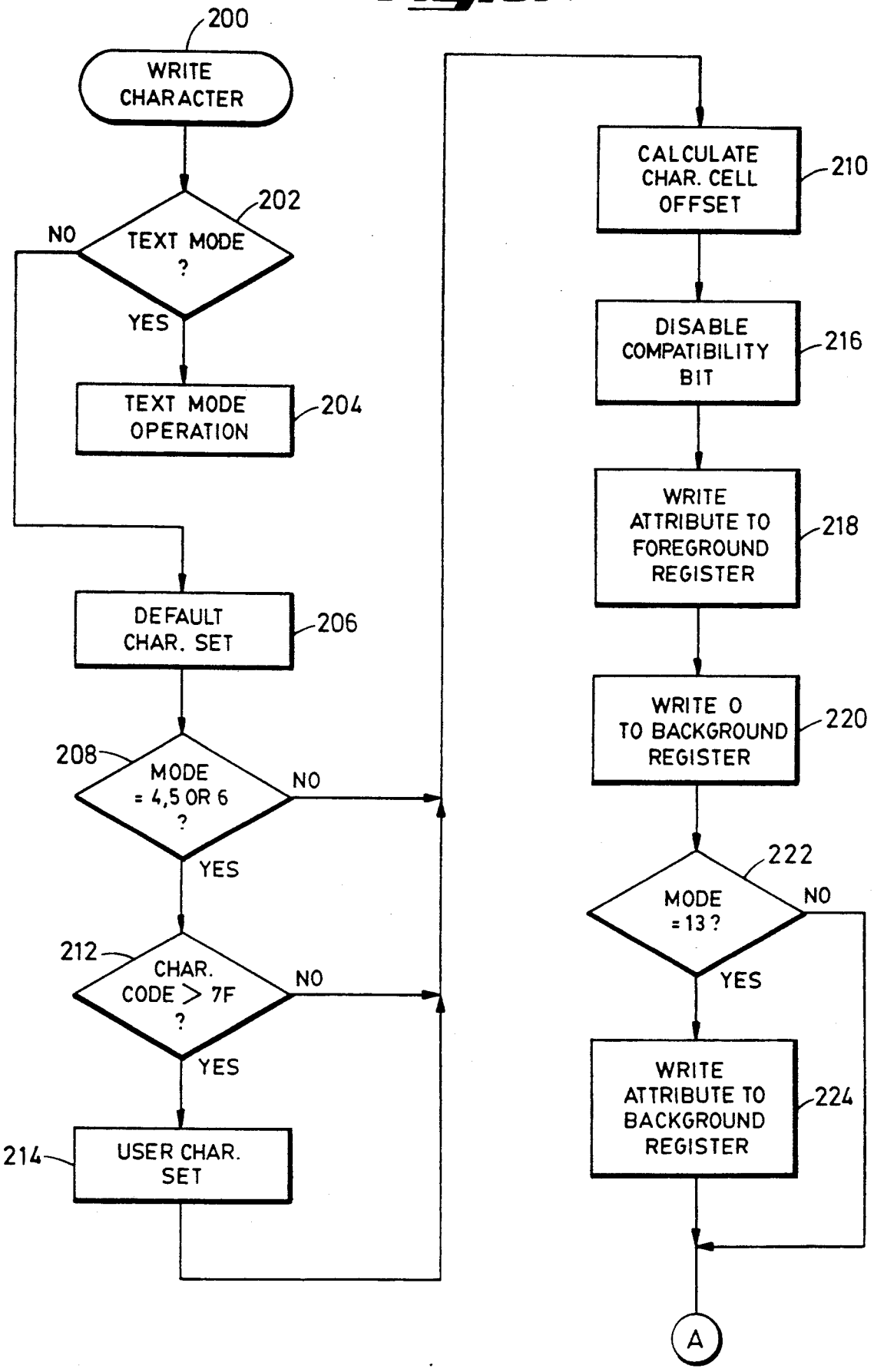
FIGS. 6A, 6B, 7A, 7B and 7C are flowchart illustrations of operating sequences utilized in a computer incorporating the present invention.
Figure 6B:
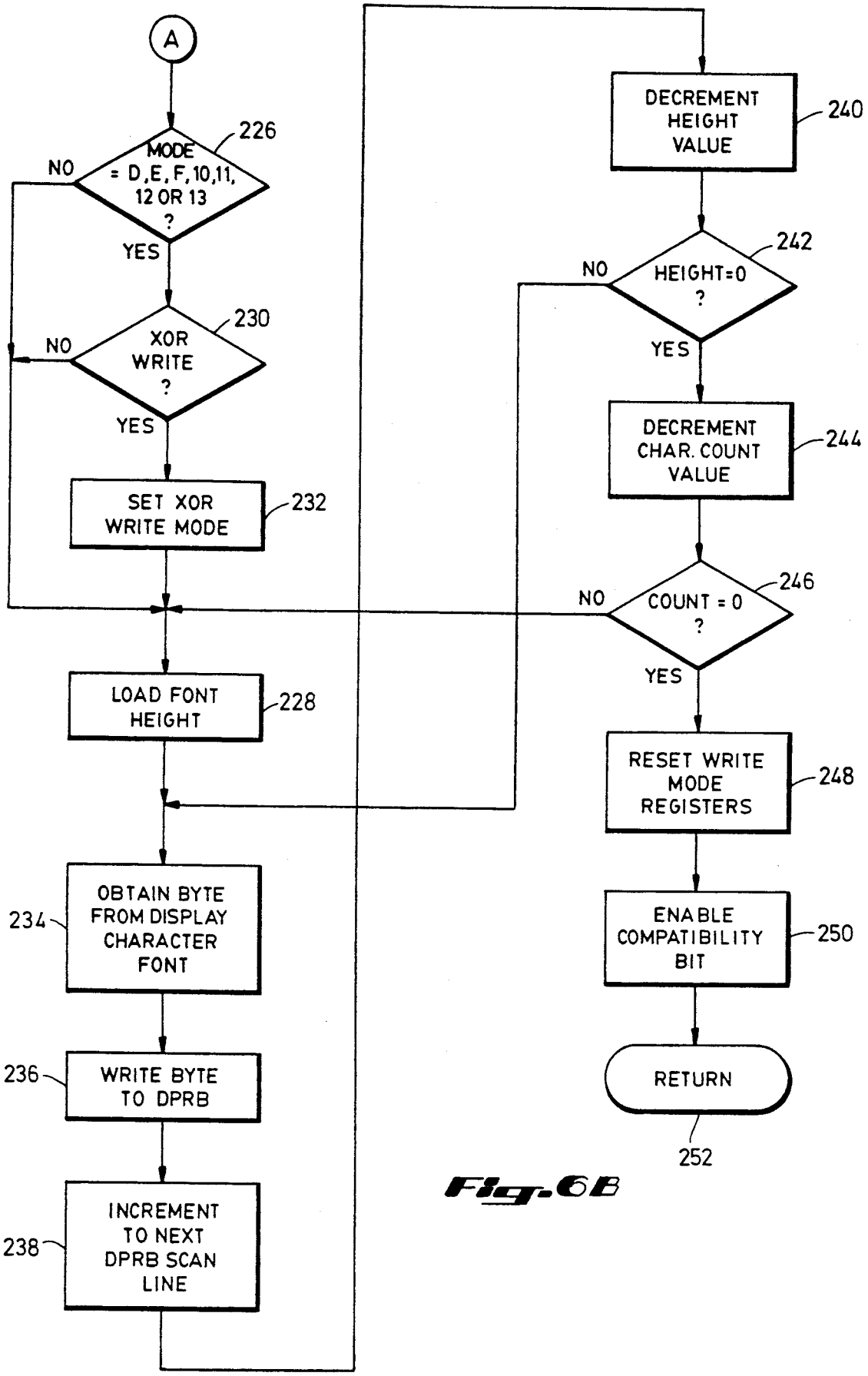

Various operating sequences are provided in the computer C to allow use of the above circuitry. The write character sequence 200 is shown in FIGS. 6A and 6B. The write character sequence 200 is a subroutine called by the main program with arguments of the character value, the attribute values, the location where the character is to be placed and the count of the characters to be written. The sequence 200 starts at step 202 where the processor 10 determines if the video system 36 is in text mode. If so, control proceeds to step 204 where conventional text mode operations are performed. If graphics mode is being used control transfers from step 202 to step 206, where the character set is loaded as the default character set. Control proceeds to step 208 where the processor 10 determines if the graphics mode is 4, 5 or 6. If is not, control proceeds to step 210. If the mode is 4, 5 or 6, control proceeds to step 212 where a determination is made if the desired character code is greater than 7P in hexadecimal. If not, control proceeds to step 210. If the code is greater than 7F control proceeds to step 214 where the user character set is used. Control then proceeds to step 210.

At step 210 the processor 10 calculates the character cell offset from the origin or other reference location. In step 216 the processor 10 disables or clears the compatibility bit. Control proceeds to step 218 where the foreground attribute value is written to the foreground attribute register 100. In the next step, step 220, a zero value is written to the background attribute register 102. In step 222 a determination is made if the graphics mode is mode 13. If so, the background attribute value is written to the background attribute register 102. Control proceeds to step 226, which is where control proceeds if the determination of step 22 is no. In step 226 the processor 10 determines if the video mode is mode D, E, F, 10, 11, 12 or 13. If not, control proceeds to step 228. If so, control proceeds to to stop 230 where a determination is made as to whether XOR write mode is selected. In XOR mode the video system 36 first reads a pixel location, inverts each bit and writes the value back to the pixel location. This mode is used in color mode because the background or foreground values may not be known and changing to preset values is not necessarily desired.

If XOR write mode is selected, control proceeds to step 232 where the mode is selected in the ASIC 50. Otherwise control proceeds to step 228, which also where control proceeds after step 232. In step 228 the height of the particular font or character to be displayed is loaded. Control proceeds to step 234, where the first byte is obtained from the display character font or mask. This example assumes that the character mask is stored in a byte wide format, with each bit representing a pixel in the array. Control proceeds to step 236 where the processor 10 writes the mask value to the video system 36 and thus to the DPRB 54 because this is a non-compatible mode write. Control proceeds to step 238 where a counter is incremented so that in the next pass through step 234 the next scan line value is obtained. The size of this increment varies depending on the array size and storage technique and the number of characters in the font. Control proceeds to step 240 where the height value is decremented. In step 242 a determination is made as to whether the height value is now zero. If not, control returns to step 234 and the next line of the mask is obtained. If the height is zero, the character has been transferred, so control proceeds to stop 244.

In step 244 the character count value is decremented. In step 246 a determination is made as to whether the count is zero and the last character has been placed in the video RAN 52. If the count is not zero control returns to step 228 and the character placement is repeated. If all the characters have been written, control proceeds to step 248 where any write mode registers are reset. Control then proceeds to step 250 where the comparability value is set to a one. The compatability value remains high except during the operation of the certain sequences so that should an application desire to perform a compatibility mode operation, the application need not be modified to require assuring that compatibility mode is set. After enabling compatibility mode, control proceeds to step 252, which is a return to the calling program.

Figure 7A:
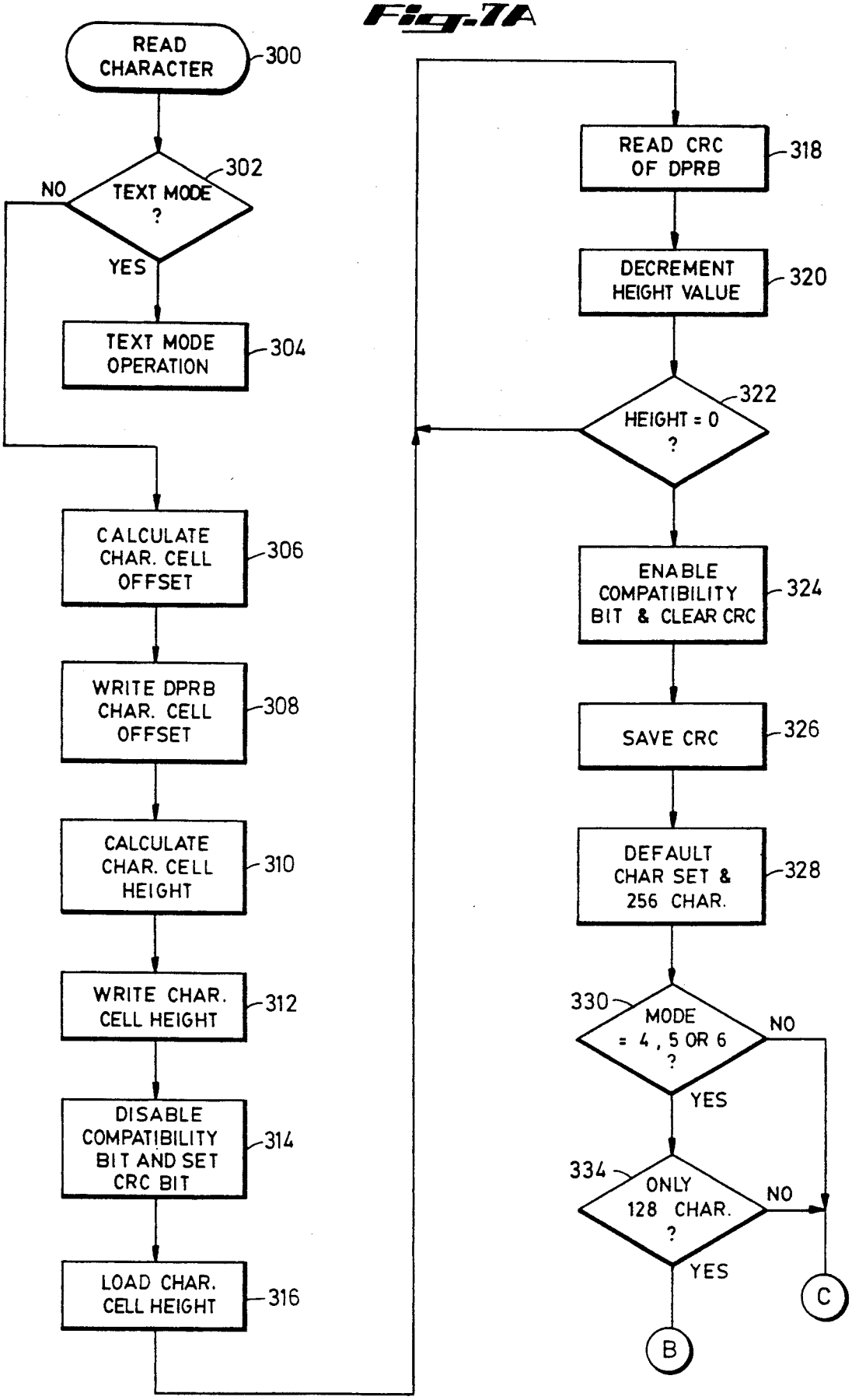
Figure 7B:
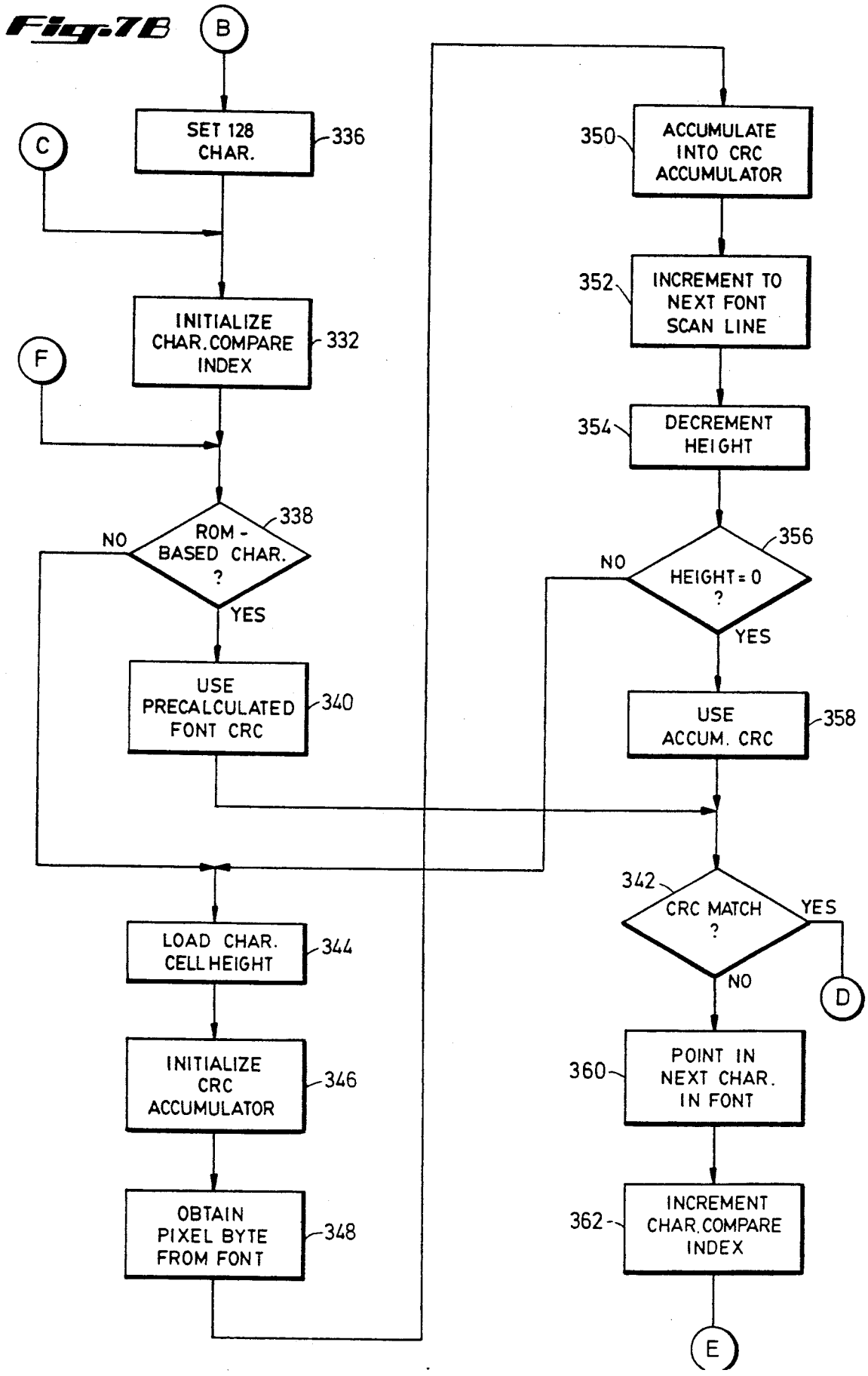
Figure 7C:
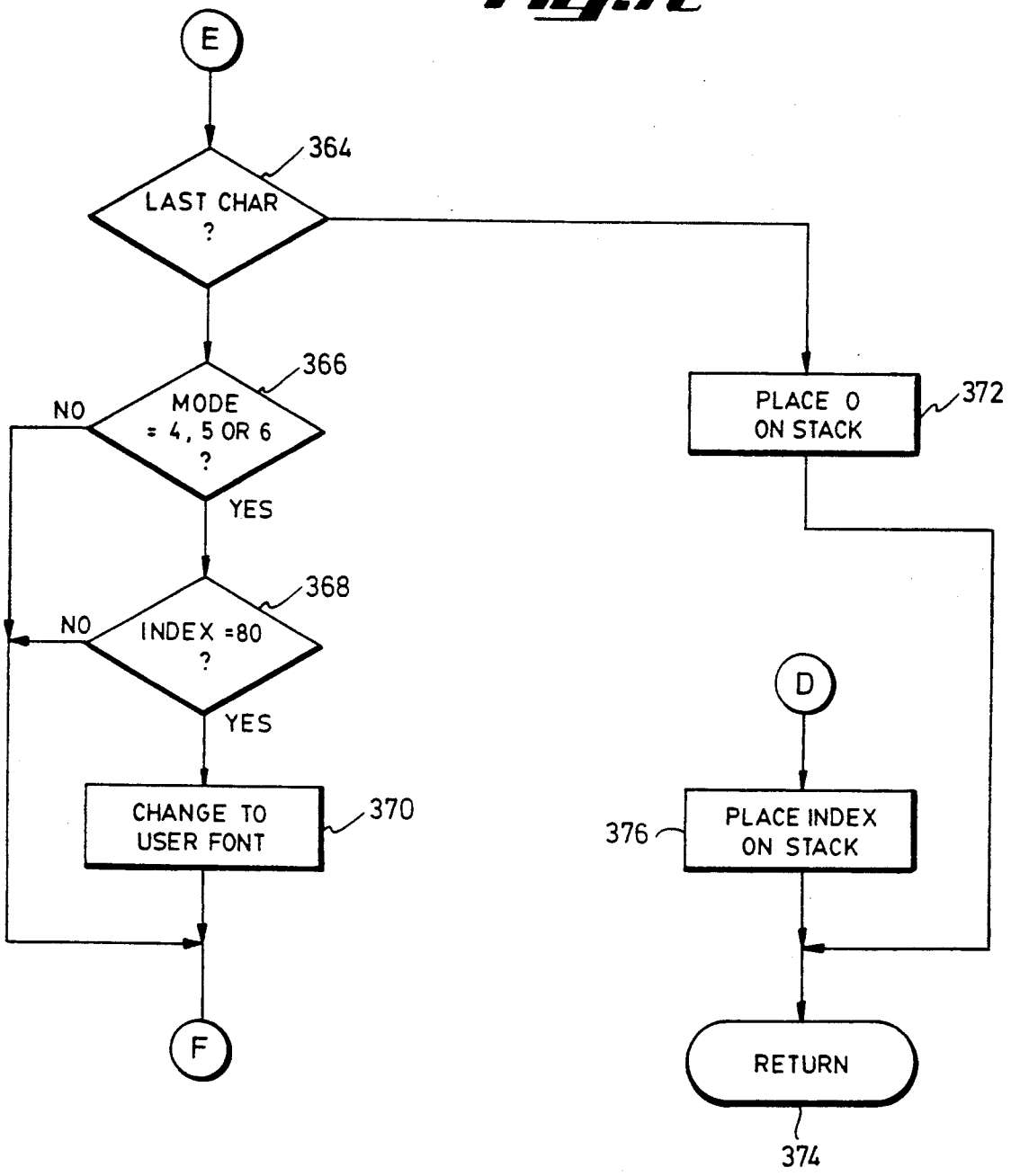

The read character sequence 300 (FIGS. 7A, 7B and 7C) commences by receiving the location of the character cell to be read and by determining in step 302 if text mode is the operating mode of the video system 36. If so, control proceeds to step where conventional text mode operations are performed. If a graphics mode is active, control proceeds from step 302 to step 306, where the processor 10 determines the character cell offset from the reference. Control then proceeds to step 308 where the character cell offset is written to the ASIC 50 for address generation purposes. In the next step, step 310, the processor 10 calculates the character cell height. This height value is written to the ASIC 50 in step 312, again for address generation purposes.

In step 314 the compatibility value or bit is disabled or set low so that non-compatibility mode is entered and the CRC request bit is set so that a signature value is obtained. In step 316 the character cell height value is loaded for looping purposes. Control proceeds to step 318 where the DPRB 54 is read so that a first CRC value is calculated and obtained. Control proceeds to step 320 where the height value is decremented. In step 322 the processor 10 determines if the height value is now zero. If not, control returns to step 318 where CRC calculations are continued. If the height value is zero, the CRC value last obtained is the final CRC value and reading of the video system 36 is completed. Therefore control proceeds to step 324 where the compatibility value is set to compatible mode and the CRC request bit is cleared, returning the CRC generator/buffer 110 to buffer mode. In step 326 the returned CRC value is saved for storage and for comparison to CRC values developed from the character masks in use.

In step 328 the default character set is used and the use of 256 characters is set. Control proceeds to step 330 where a determination is made as to whether mode 4, 5 or 6 is active. If not, control proceeds to step 332. If so, control proceeds to step 334 where a determination is made if only 128 characters are to be compared. If not, control proceeds to step 332. If so, control proceeds to step 336. In step 336 the use of 128 characters is set. Control then transfers to step 332.

In step 332 the processor 10 initializes the character compare index to zero. Control proceeds to step 338 where a determination is made as to whether a ROM-based character set is used. If so, a precalculated CRC value is used and control proceeds to step 342. If a ROM font is not being used, control proceeds to step 344 where the character cell height is loaded. In step 346 the processor initializes a CRC accumulator. Control proceeds to step 348 where the processor 10 obtains the pixel byte from the character mask or font. In the next step, step 350, the byte value is accumulated into the CRC accumulator to develop a CRC value. Control proceeds to step 352 where a counter is incremented to the next scan line in the mask. In step 354 the height value is decremented. Control proceeds to step 356 where a determination is made if the height is zero. If not, control returns to step 344 and the CRC development continues. If so, control proceeds to step 358 where the calculated CRC value is used for comparison purposes.

Control proceeds to step 342 where a determination is made as to whether the character cell CRC value as obtained in the DPRB 54 read operations is equal to the CRC value from steps 340 or 358. If not, control proceeds to step 360, where a pointer is increased to point to the next character in the font. Then in step 362 the character compare index is incremented. In step 364 a determination is made if this was the last character. If not, control proceeds to step 366, which is a mode 4, 5 or 6 check. If the mode is not 4,5 or 6, control returns to step 338 and the next character is evaluated. If it is mode 4, 5 or 6 control proceeds to step 368 where a determination is made as to of the index value is equal to hex 80. If not, control proceeds to step 338. If so, control proceeds to step 370, where a switch is made to comparing against the user font and control proceeds to step 338.

If in step 364 it was determined that this was the last character, a match was not found and so a character is not present in the requested cell. Control proceeds to step 372 where a zero value is placed on the stack for return to the calling program. Control proceeds to step 374, the return to the calling program.

If it was determined in step 342 that there was a CRC match, this indicates that the character was indeed found and so the value needs to be returned to the calling program. This is done in step 376 by placing the index value on the stack, which is followed by step 374.

The foregoing disclosure and description of the invention are illustrative and explanatory thereof, and various changes in the size, shape, materials, components, circuitry, wiring connections and contacts, as well as in the details of the illustrated circuitry and construction and method of operation may be made without departing from the spirit of the invention.

We claim:

1. A display system for use in a computer having a processor providing display information to locations of the display system, the display system having means for converting information into a form for driving a display device, the display system comprising:

a first buffer having a plurality of locations for storing character dot image values;

a second buffer having a plurality of locations for storing attribute values associated with each character dot image value;

a third buffer having a plurality of locations for storing background attribute values associated with each character dot image value, and wherein said second buffer stores foreground attribute values and said character dot image values indicate the use of foreground or background attribute values; and means for determining if an attribute value written to said second buffer by the procession is nonzero and for writing a zero to the location in said first buffer associated with the location of the attribute buffer write if the attribute value is zero and a one to the location if the attribute value is nonzero.

2. The display system of claim 1, further comprising:

means for directing said written attribute value to said second buffer and for writing a zero value in the corresponding location in said third buffer.

* * * * *

UNITED STATES PATENT AND TRADEMARK OFFICE

CERTIFICATE OF CORRECTION

PATENT NO. : 5,248,964

DATED : September 28, 1993

INVENTOR(S) : Glenn A. Edgard, et al.

It is certified that error appears in the above-identified patent and that said Letters Patent is hereby corrected as shown below:

Claim 1, column 12, line 7, change "procession" to --processor--.

Signed and Sealed this

Twenty-ninth Day of March, 1994

Bruce Lehman

*Attest:*

BRUCE LEHMAN

*Attesting Officer*

*Commissioner of Patents and Trademarks*